US005112731A

United States Patent [19]

Miyasaka

[11] Patent Number: 5,112,731

[45] Date of Patent: May 12, 1992

[54] SILVER HALIDE PHOTOGRAPHIC MATERIAL

[75] Inventor: Nobuaki Miyasaka, Kanagawa, Japan

[73] Assignee: Fuji Photo Film Co., Ltd., Kanagawa, Japan

[21] Appl. No.: 574,863

[22] Filed: Aug. 30, 1990

Related U.S. Application Data

[60] Division of Ser. No. 501,396, Mar. 27, 1990, which is a continuation of Ser. No. 181,331, Apr. 14, 1988, abandoned.

[30] Foreign Application Priority Data

Apr. 14, 1987 [JP] Japan ..... 62-91424

[51] Int. Cl.[5] ..... G03C 1/035; G03C 1/12

[52] U.S. Cl. ..... 430/567; 430/572; 430/573; 430/576; 430/578; 430/582; 430/592; 430/963; 430/966

[58] Field of Search ..... 430/567, 572, 573, 576, 430/578, 582, 592, 963, 966

[56] References Cited

U.S. PATENT DOCUMENTS

| | | | |
|---|---|---|---|
| 4,536,473 | 8/1985 | Mihara | 430/575 |
| 4,581,329 | 4/1986 | Sugimoto et al. | 430/591 |
| 4,582,786 | 4/1986 | Ikeda et al. | 430/577 |
| 4,607,006 | 8/1986 | Hirano et al. | 430/572 |
| 4,672,025 | 6/1987 | Yamada et al. | 430/420 |
| 4,713,321 | 12/1987 | Mifune et al. | 430/569 |
| 4,797,353 | 1/1989 | Yamada et al. | 430/434 |
| 4,861,702 | 8/1989 | Suzuki et al. | 430/564 |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide photographic material is disclosed, which comprises a support having coated thereon at least one silver halide emulsion layer, wherein the emulsion layer comprises tabular grains of silver chloride, silver bromide, silver chlorobromide or silver chloroiodobromide having an iodide content of 1 mol % or less, which have an average aspect ratio of 3 or more and which have been spectrally sensitized with at least one spectral sensitizing dyes described below.

17 Claims, 1 Drawing Sheet

FIGURE
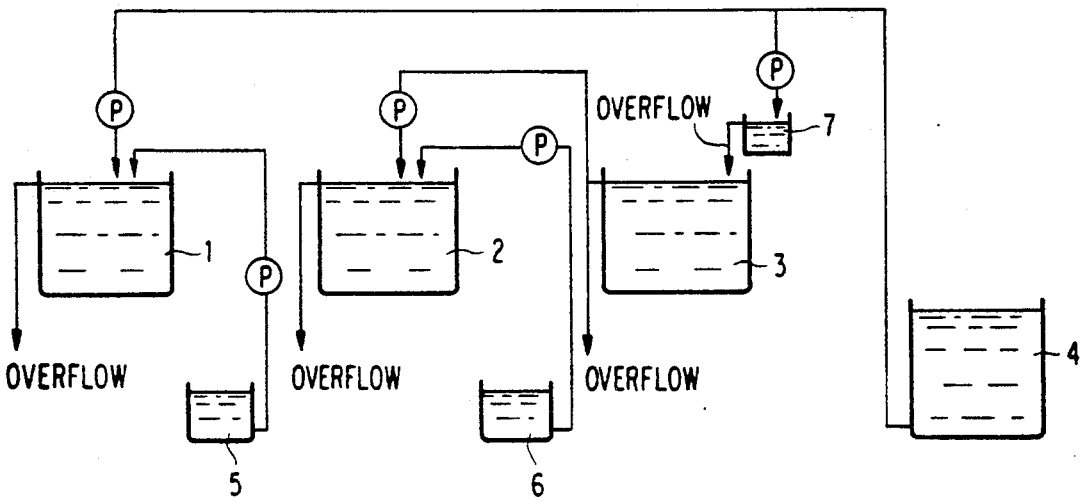

SILVER HALIDE PHOTOGRAPHIC MATERIAL

This is a divisional of application Ser. No. 07/501,396 filed Mar. 27, 1990now pending, which is a continuation of application Ser. No. 07/181/331 filed Apr. 14, 1988, now abandoned.

FIELD OF THE INVENTION

The present invention relates generally to silver halide photographic materials (hereinafter, referred to as "photographic materials"), and particularly, to photographic materials wherein the rate of development and the drying characteristics are remarkably improved. Also, processing them by a rapid automatic developing machine within 45 seconds in a dry-to-dry manner is possible. The photographic materials are highly sensitive and have a highly developed silver covering power. More particularly, the present invention relates to easy-type processing that is combined with a developing solution free of a processing hardening agent. The present invention also relates to photographic materials having a silver halide emulsion on one or both surfaces of a support that is mainly used for X-ray images, CRT images and laser scanning images.

BACKGROUND OF THE INVENTION

High temperature rapid processing of photographic materials by automatic developing machines is well known. Almost 20 years have passed since the introduction of 90 second rapid processing by a dry-to-dry manner of photographic materials for X-ray image diagnosis. Demand for the increased simplification and the rapidity of the processing has become strong recently since electronic equipment and processing equipment have become to be used in combination. In Japanese Patent Application No. 27340/87, a simple, rapid technique of processing photographic materials for semiconductor lasers that uses a combined-type highly active developing solution and fixing solution free from glutaraldehyde is disclosed. However, this technique is unsatisfactory for conventional photographic materials for X-ray image diagnosis because it is difficult to adjust the rate of development and highly developed silver covering power to desirable levels when drying characteristics are set at a level that enables rapid processing. In Japanese Patent Application (OPI) Nos. 111935/83, 111936/83, 111937/83 and 113927/83, (the term "OPI" as used herein means a "published unexamined Japanese patent application"), tabular grain emulsion techniques are disclosed, and the highly developed silver covering power and the high photosensitivity of the emulsions are described. In U.S. Pat. No. 4,414,304 and Japanese Patent Application (OPI) No. 111933/83, techniques are disclosed that include tabular grains that have been subjected to preliminary hardening and that provide a high rate of development and highly developed silver covering power and wherein the degree of swelling is 200% or less. However, these disclosed techniques are unsatisfactory because they do not allow rapid development within 45 seconds by a dry-to-dry manner.

SUMMARY OF THE INVENTION

An object of the invention is to provide a silver halide photographic material wherein the rate of development and the drying characteristics are remarkably improved; processing it by rapid processing within 45 seconds in a dry-to-dry manner is possible, that is highly sensitive, and has a highly developed silver covering power. Particularly, the present invention provides a silver halide photographic material that is used in combination with a developing solution free of a processing hardening agent.

The object of the present invention has been attained by providing a silver halide photographic material comprising a support having coated thereon at least one silver halide emulsion layer and at least one light-insensitive hydrophilic colloid layer, wherein the emulsion layer comprises tabular grains of silver chloride, silver bromide, silver chlorobromide, or silver chloroiodobromide having an iodide content of 1 mol% or less, which have an average aspect ratio of 3 or more and which have been spectrally sensitized with at least one of the spectral sensitizing dyes represented by general formulae (I), (II), (III), (IV), (V) and (VI):

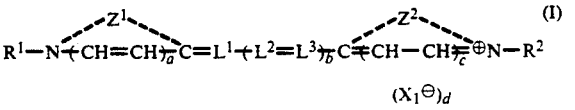

(I)

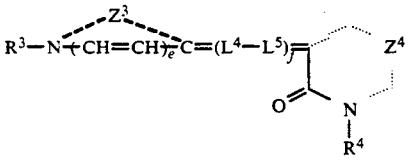

(II)

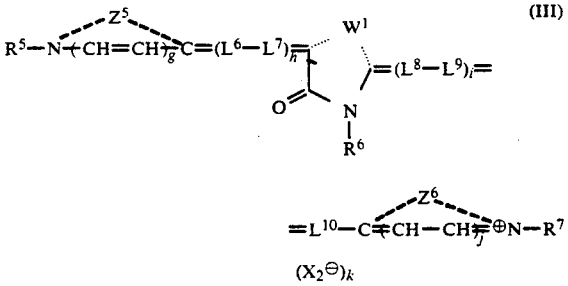

(III)

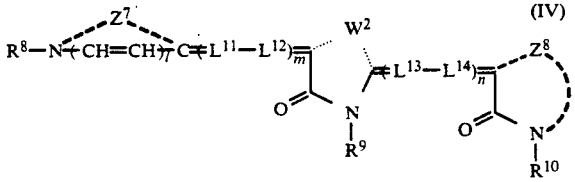

(IV)

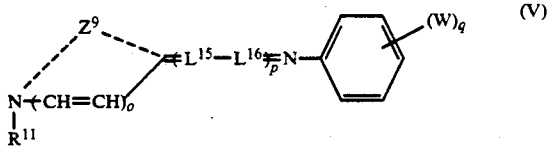

(V)

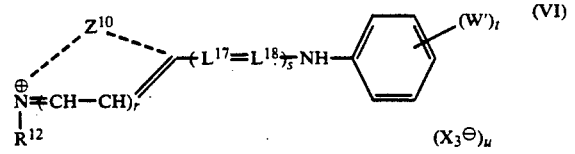

(VI)

wherein, $Z^1$ to $Z^{10}$ and $W^1$ and $W^2$, which may be the same or different, each represents a group of nonmetal atoms, which together with the adjacent atoms, form a 5- or 6-membered heterocyclic ring; $R^1$, $R^2$, $R^3$, $R^5$ $R^7$, $R^8$, $R^{11}$ and $R^{12}$, which may be the same or different, each represents a substituted or unsubstituted alkyl group; $R^4$, $R^6$, $R^9$, and $R^{10}$ each represents a hydrogen atom, a substituted or unsubstituted alkyl group, a substituted or unsubstituted aryl group, or a heterocyclic group; a, c, d, e, g, h, j, k, l, o, r and u each independently is 0 or 1; b, f, i, m, n, p, q, s and t each independently is 0, 1, 2 or 3; $L^1$ to $L^{18}$ each represents a substituted or unsubstituted methine group; $X_1$ to $X_3$ each represents an anion; and W and W' each represents a halogen atom, a cyano group, an alkoxycarbonyl group, a substituted or unsubstituted carbamoyl group, a substituted or unsubstituted sulfamoyl group, a substituted or unsubstituted alkyl group, a substituted or unsubstituted alkoxy group or a substituted or unsubstituted acyl group and wherein the melting time of the hydrophilic colloid layer in the photographic material is from 70 to 200 minutes.

BRIEF DESCRIPTION OF THE FIGURE

The Figure represents a schematic view of the automatic developing machine used in Example 1. Reference numeral 1 indicates a developing tank; reference numeral 2 indicates a fixing tank; reference numeral 3 indicates a washing tank; reference numeral 4 indicates a water stock tank; reference numeral 5 indicates a water stock tank of developer condensed solution; reference numeral 6 indicates a water stock tank of fixer condensed solution; reference numeral 7 indicates a squeezing roller washing tank; and symbol (p) indicates a pump.

DETAILED DESCRIPTION OF THE INVENTION

In the present invention, the "aspect ratio" is the ratio of the diameter of silver halide grains (the diameter of the circle having the same area as the projected area of the grains) to the grain thickness.

In the present invention, the "average aspect ratio" is the average value of the aspect ratios of all the tabular grains contained in an emulsion. Herein, the term "tabular grains" refers to grains having a diameter, which corresponds to a circle, of 0.4 μm or more and a grain thickness of 0.3 μm or less.

Although the average aspect ratio can be calculated by finding the aspect ratio of each tabular grain to find the average value thereof, alternatively it is possible simply to calculate the average diameter of the tabular grains and the average tabular grain thickness to find the average aspect ratio.

Preferably, both methods are used and that large one of the two average aspect ratios is taken.

In the present silver halide emulsion layer, it is preferable that tabular grains occupy 50% or more of all grains in terms of the projected area.

More preferably, the present silver halide emulsion layer is a tabular grain emulsion layer. The "tabular grain emulsion" as used herein means an emulsion comprising 90 wt% or more of tabular grains. In this case, the aspect ratio can be calculated by removing the non-tabular grains in the emulsion.

In the present invention, the term "melting time" of the hydrophilic colloid layer means the time required to start dissolving the hydrophilic colloid layer of the silver halide photographic material when the silver halide photographic material is immersed in a solution containing 1.5 wt% of sodium hydroxide aqueous solution at 50° C. and allowed to stand.

Light-sensitive silver halide emulsions having an average aspect ratio of 3 or more used in the present invention include silver bromide emulsions, silver chloride emulsions, silver chlorobromide emulsions and silver iodobromide emulsions having an iodine content of 1 mol% or less. Silver chlorobromide grain emulsions containing less than 30 mol% of silver chloride are particularly preferably used. Although it is good if the average aspect ratio of emulsion grains is 3 or more, it is preferable that the average aspect ratio of emulsion grains is 5 or more, more preferably 7 or more, and most preferably 10 or more. As the upper limit of the aspect ratio, 20 or less is preferred. Preferably, the average grain size is 0.4 μm or more, more preferably from 0.5 μm to 2.0 μm. It is preferable that the grain size distribution is narrow. Particularly, it is preferable that 70% or more, more preferably 80% or more, and most preferably 90% or more, of all the grains fall within the average grain size ±40%. When emulsion grains having a broader grain size distribution are to be used to obtain a greater exposure latitude, it is desirable to mix them with emulsion grains having narrow grain size distributions or to use emulsion grains having narrow grain size distributions to be applied as separate layers than to use a polydispersed emulsion. Grains having an average aspect ratio of 3 or more used in the present invention can be prepared by methods as described in U.S. Pat. Nos. 4,425,425, 4,425,426, 4,434,226, and 4,439,520; Japanese Patent Application (OPI) Nos. 108525/83, 113927/83, 111935/83, 111936/83, and 111937/83; British Patents 2,110,405, and 2,109,577, and Japanese Patent Application Nos. 186481/86, 146599/86, and 144228/86. Examples of preferred silver halide solvents used in these methods include thioethers, thiocyanates, ammonia, thiazolidinenithion and tetrasubstituted thioureas. To react a soluble silver salt with a soluble halide, any of the single-jet method, the double-jet method, a combination thereof, and others can be used.

A process of forming silver halide grains in the presence of an excess of silver ions, the so-called reverse mixing method, can also be used. As one type of the double-jet method, pAg in the liquid phase in which a silver halide is produced is kept constant. This method is termed the controlled double-jet method.

The crystalline structure of the grains of silver halides may be such that the structure is uniform in the inside, or that the inside and the outside have different layered structures, or may be a structure as described in British Patent 635,841 and U.S. Pat. No. 3,622,318, that is, those of the so-called conversion type. Silver halides having different compositions may be joined epitaxially or may be joined to compounds other than silver halides, such as silver rhodanate or silver oxide. Concerning the latent image distribution, either the surface latent image type or the internal latent image type is possible.

In the process of the formation or physical ripening of silver halide grains, cadmium salts, zinc salts, lead salts, thallium salts, iridium salts or its complex salts, rhodium salts or its complex salts, iron salts or iron complex salts may also be present.

Spectral sensitizing dyes having general formulae (I), (II), (III), (IV), (V) and (VI) will be described in detail below.

Examples of 5- to 6-membered heterocyclic rings formed by $Z^1$, $Z^2$, $Z^3$, $Z^5$, $Z^6$, $Z^7$, $Z^9$ and $Z^{10}$ include a thiazole nucleus (e.g., thiazole, 4-methylthiazole, 4-phenylthiazole, 4,5-dimethylthiazole, and 4,5-diphenylthiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5-hydroxy-6-methylbenzothiazole, tetrahydrobenzothiazole, and 4-phenylbenzothiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole), a thiazoline nucleus (e.g., thiazoline, 4-methylthiazoline, and 4-nitrothiazoline), an oxazole nucleus (e.g., oxazole, 4-methyloxazole, 4-nitrooxazole, 5-methyloxazole, 4-phenyloxazole, 4,5-diphenyloxazole, and 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), a naphthoxazole nucleus (e.g., naphth[2,1-d]oxazole, naphth[1,2-d]oxazole, naphth[2,3-d]oxazole, and 5-nitronaphth[2,1-d]oxazole), an oxazoline nucleus (e.g., 4,4-dimethyloxazoline), a selenazole nucleus (e.g., 4-methylselenazole, 4-nitroselenazole, and 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, and 5-chloro-6-nitrobenzoselenazole), a naphthoselenazole nucleus (e.g., naphtho[2,1-d]selenazole, and naphtho[1,2-d]selenazole), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine), an imidazole nucleus (e.g., 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-alkylnaphtho[1,2-d]imidazole, 1-allyl-5,6-dichlorobenzimidazole, 1-allyl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, and 1-arylnaphtho[1,2-d]imidazole), wherein the alkyl group is preferably unsubstituted and has from 1 to 8 carbon atoms such as methyl, ethyl, propyl, isopropyl and butyl, and a hydroxyalkyl group (e.g., 2-hydroxyethyl and 3-hydroxypropyl), more preferably a methyl group or ethyl group, and the aryl group represents, for example, a phenyl group, a halogen-substituted (e.g., chloro-substituted) phenyl group, lower alkyl-substituted (e.g., methyl-substituted) phenyl group, or lower alkoxy-substituted (e.g., methoxy-substituted) phenyl group, a pyridine nucleus (e.g., 2-pyridine, 4-pyridine, 5-methyl-2-pyridine, and 3-methyl-4-pyridine), a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline, and 6-nitro-3-isoquinoline), an imidazo[4,5 b]quinoxaline nucleus (e.g., 1,3-diethylimidazo[4,5-b]quinoxaline, and 6-chloro-1,3-diallylimidazo-4,5-b]quinoxaline), an oxadiazole nucleus, a thiadiazole nucleus, a tetrazole nucleus, and a pyrimidine nucleus.

Examples of 5- to 6-membered heterocyclic rings formed by $Z^4$ and $Z^8$ include a rhodanine nucleus, a 2-thiohydantoin nucleus, a 2-thioxooxazolidine-4-one nucleus, a 2-pyrazolin-5 one nucleus, a barbituric acid nucleus, a 2-thiobarbituric acid nucleus, a thiazolidin-2,4-dione nucleus, a thiazolidin-4-one nucleus, an isooxazolone nucleus, a hydantoin nucleus, and an indandione nucleus.

5- to 6-membered heterocyclic rings formed by $W^1$ and $W^2$ are those excluding an oxo group or a thioxo group suitably positioned relative to the 5- to 6-membered heterocyclic ring formed by $Z^4$ and $Z^8$. For the methine groups and the substituted methine groups represented by $L^1$, $L^2$, $L^3$, $L^4$, $L^5$, $L^6$, $L^7$, $L^8$, $L^9$, $L^{10}$, $L^{11}$, $L^{12}$, $L^{13}$, $L^{14}$, $L^{15}$, $L^{16}$, $L^{17}$ and $L^{18}$, the substituents include, for example, a lower alkyl group (e.g., methyl and ethyl), an aryl group (e.g., phenyl), an aralkyl group (e.g., benzyl), a halogen atom (e.g., chlorine, and bromine), and a lower alkoxy group (e.g., methoxy and ethoxy), and the substituents on the methine chain may form a 4- to 6-membered ring.

Examples of the optionally substituted alkyl groups represented by $R^1$, $R^2$, $R^3$, $R^5$, $R^7$, $R^8$, $R^{11}$ and $R^{12}$ include an alkyl group having 1 to 18, preferably 1 to 7, and most preferably 1 to 4 carbon atoms {e.g., an unsubstituted alkyl group (e.g., methyl, ethyl, propyl, isopropyl, butyl, isobutyl, hexyl, octyl, dodecyl, and octadecyl), a substituted alkyl group such as an aralkyl group (e.g., benzyl and 2-phenylethyl), a hydroxylalkyl group (e.g., 2-hydroxylethyl and 3-hydroxylpropyl), a carboxylalkyl group (e.g., 2-carboxylethyl, 3-carboxylpropyl, 4-carboxylbutyl and carboxymethyl), an alkoxyalkyl group (e.g., 2-methoxyethyl, and 2-(2-methoxyethoxy)ethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, and 3-sulfopropoxyethoxyethyl), a sulfatoalkyl group (e.g., 3-sulfatopropyl and 4-sulfatobutyl), a heterocyclic ring-substituted alkyl group (e.g., 2-(pyrrolidin-2-one-1-yl)ethyl, and tetrahydrofurfuryl), a 2-acetoxyethyl group, a carbomethoxymethyl group, a 2-methanesulfonylaminoethyl group and an allyl group.

Examples of the alkyl group, the substituted alkyl group, the aryl group, the substituted aryl group, and the heterocyclic group represented by $R^4$, $R^6$, $R^9$, and $R^{10}$ include an alkyl group having 1 to 18, preferably 1 to 7, and most preferably 1 to 4 carbon atoms (e.g., a methyl group, an ethyl group, a propyl group, an isopropyl group, a butyl group, an isobutyl group, a hexyl group, an octyl group, a dodecyl group, and an octadecyl group), a substituted alkyl group such as an aralkyl group (e.g., a benzyl group, and a 2-phenylethyl group), a hydroxylalkyl group (e.g., a 2-hydroxyethyl group, and a 3-hydroxypropyl group), a carboxyalkyl group (e.g., a 2-carboxylethyl group, a 3-carboxypropyl group, a 4-carboxybutyl group, and a carboxymethyl group), an alkoxyalkyl group (e.g., a 2-methoxyethyl group, and a 2-(2-methoxyethoxy)ethyl group), a sulfoalkyl group (e.g., a 2-sulfoethyl group, a 3-sulfopropyl group, a 3-sulfobutyl group, a 4-sulfobutyl group, a 2-[3-sulfopropoxy]ethyl group, a 2-hydroxy-3-sulfopropyl group, and a 3-sulfopropoxyethoxyethyl group), a sulfatoalkyl group (e.g., a 3-sulfatopropyl group, and a 4-sulfatobutyl group), a heterocyclic ring-substituted alkyl group (e.g., a 2-(pyrrolidin-2-one-1-yl)ethyl group, a tetrahydrofurfuryl group, and a 2-morpholinoethyl group), a 2-acetoxyethyl group, a carbomethoxymethyl group, a 2-methanesulfonylaminoethyl group, and an allyl group, an aryl group (e.g., a phenyl group, and a 2-naphthyl group), a substituted aryl group (e.g., a 4-carboxyphenyl group, a 4-sulfophenyl group, a 3-chlorophenyl group and a 3-methylphenyl group), and a heterocyclic ring group (e.g., a 2-pyridyl group and a 2-thiazolyl group).

a, c, d, e, g, h, j, k, o, r and u independently are 0 or 1. b, f, i, m, n, p, q, s and t independently are 0, 1, 2, or 3.

Spectral sensitizing dyes preferably used in the present invention are the compounds represented by the above general formulae (I), (II) and (III).

Examples of specific spectral sensitizing dyes used in the present invention are shown below.

1

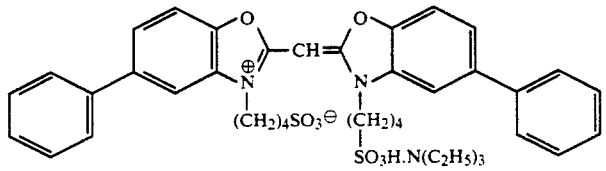

2

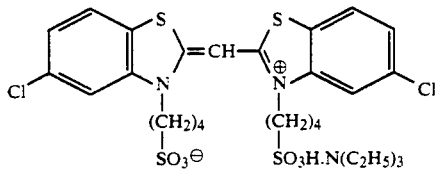

3

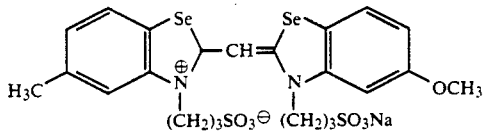

4

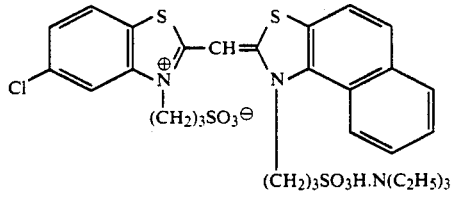

5

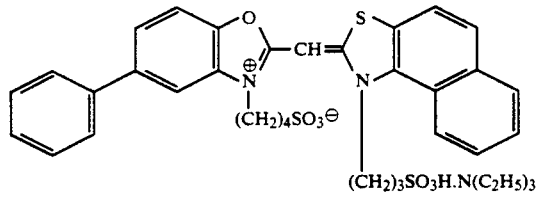

6

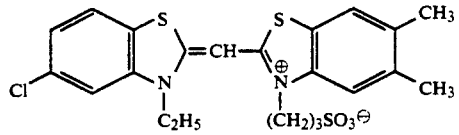

7

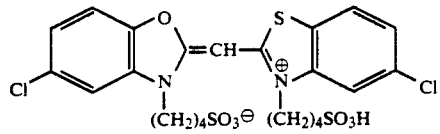

-continued
8
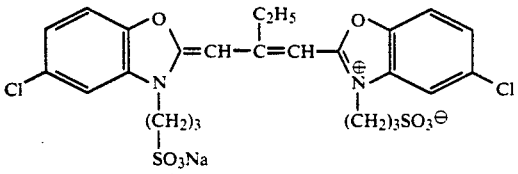
9
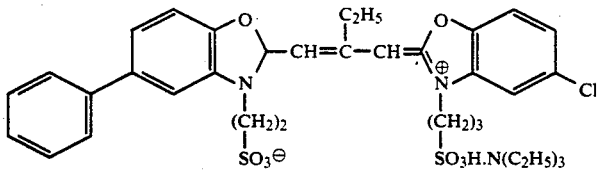
10
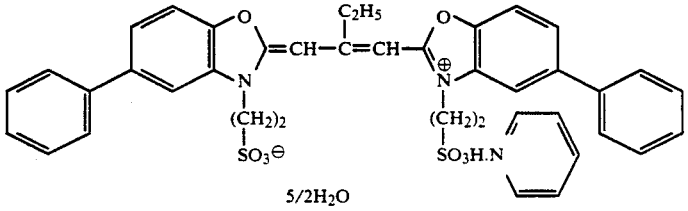
$5/2H_2O$
11
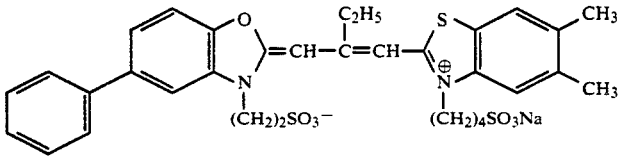
12
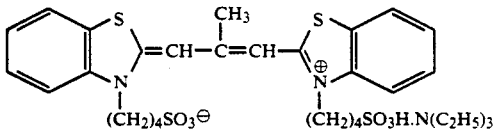
13
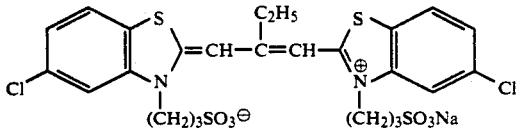
14
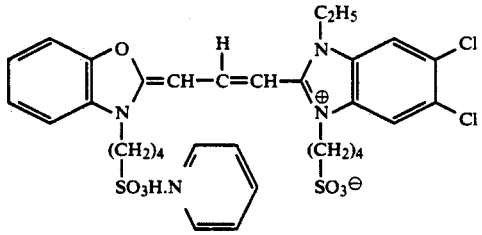
15
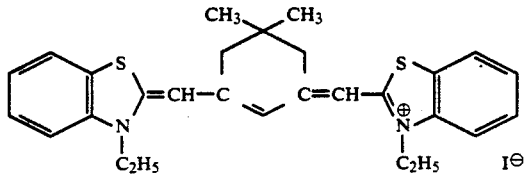

-continued
16
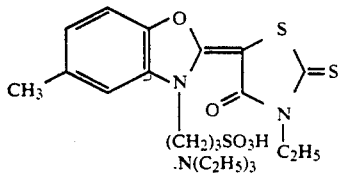
17
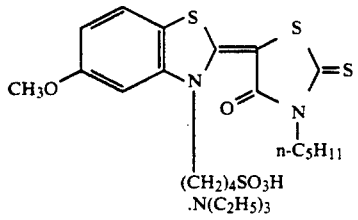
18
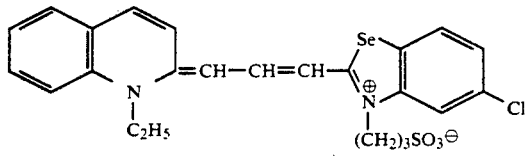
19
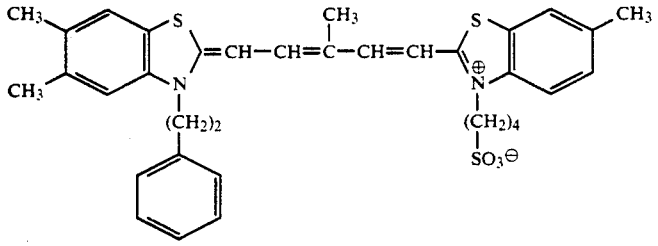
20
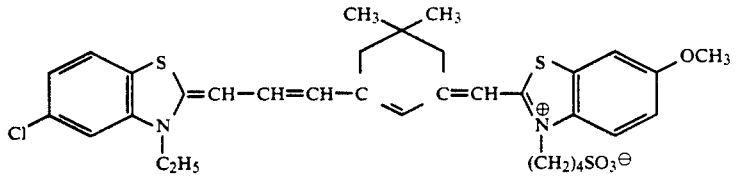
21
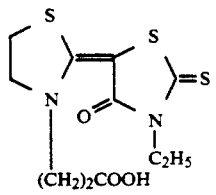
22
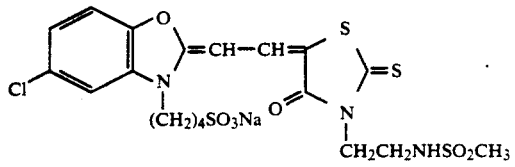

-continued
23
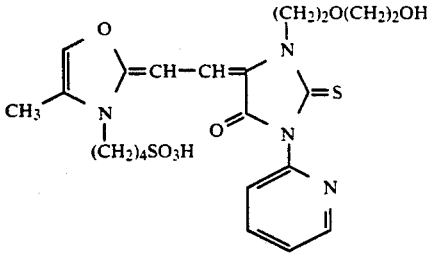
24
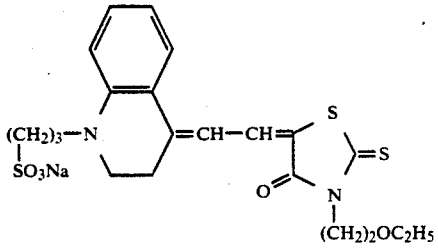
25
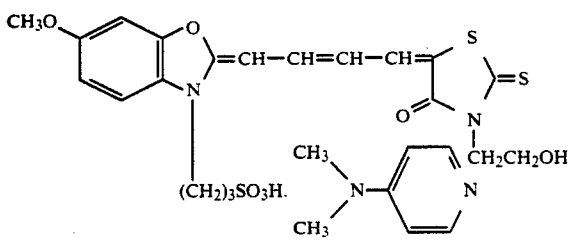
26
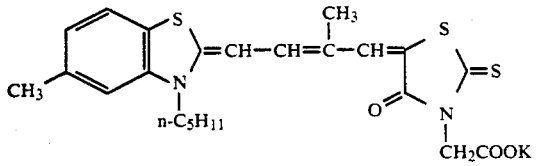
27
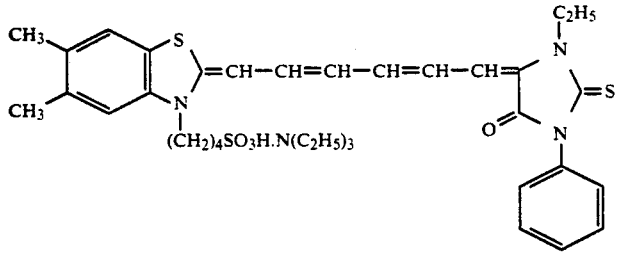
28
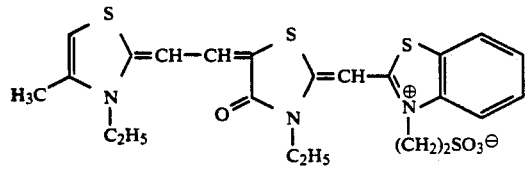
29
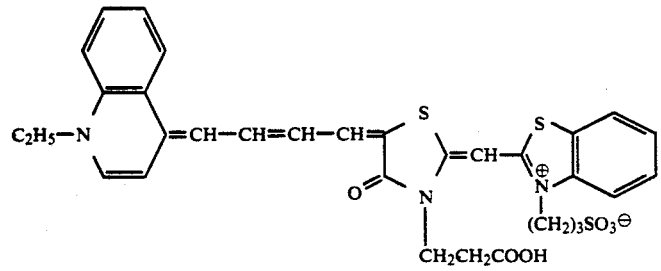

-continued

30

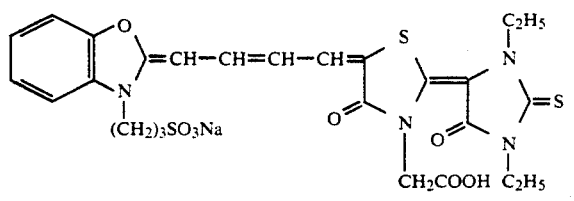

31

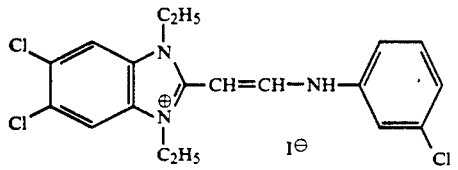

32

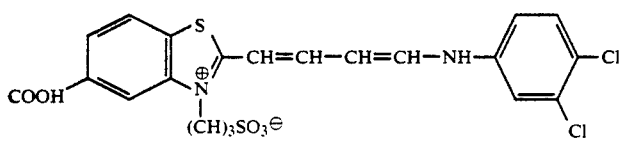

33

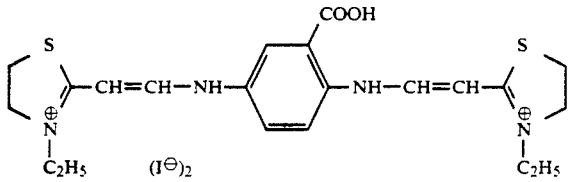

34

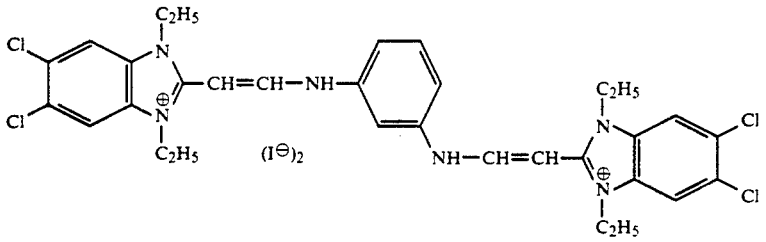

The instant spectral sensitizing dyes can be added to the emulsion at any time between the completion of the addition of silver ions and immediately before coating, although it is preferable that they are added between the completion of the addition of silver ions and before the step of chemical sensitization. It is most preferable that they are added after the addition and dissolving of redispersed gelatin after the desalting but before the start of the chemical sensitization.

The total amount of the compounds represented by general formula (I), (II), (III), (IV), (V), or (VI) to be added can be from $4\times10^{-6}$ to $8\times10^{-3}$ mols per mol of the silver halide of the silver halide emulsion.

The silver halide emulsion used in the present invention is preferably chemically sensitized. Chemical sensitization methods include sulfur sensitization, reduction sensitization, and noble metal sensitization. These methods can be used alone or in combination.

Of noble metal sensitization methods, the gold sensitization method is typical and involves the use of gold compounds, generally gold complex salts. Complex salts of other noble metals such as platinum, palladium, and iridium can also be used. Specific examples thereof are described in U.S. Pat. No. 2,448,060 and British Patent 618,061.

Sulfur sensitizing agents include, in addition to sulfur compounds contained in gelatin, thiosulfates, thioureas, thiazoles, and rhodanines. Specific examples thereof are described in U.S. Pat. Nos. 1,574,944, 2,278,947, 2,410,689, 2,728,668, 3,501,313, and 3,656,955.

Reduction sensitizing agents include stannous salts, amines, formamidinesulfinic acid, and silane compounds. Specific examples thereof are described in U.S. Pat. Nos. 2,487,850, 2,518,698, 2,983,609, 2,983,610, and 2,694,637. Selenium compounds can also be used.

As binders or protective colloids that can be used in the emulsion layers and intermediate layers of the present photographic material, it is preferable to use gelatin, although other hydrophilic colloids can be used. For example, use can be made of gelatin derivatives, graft polymers of gelatin with other polymers; proteins such as casein and alubumin; cellulose derivatives such as hydroxyethylcellulose, carboxymethylcellulose, and cellulose sulfate; saccharides such as starch derivatives, dextran, and sodium alginate; and synthetic hydrophilic polymers such as monopolymers and copolymers for example polyvinylalcohol, polyvinylalcohol partial acetal, poly-N-vinylpyrrolidone, polyacrylic acid, polymethacrylic acid, polyacrylamide, polyvinylimidazole, and polyvinylpyrazole.

As gelatin, use can be made, in addition to lime-processed gelatin, of acid-processed gelatin and enzyme-processed gelatin. Hydrolyzates and enzymolysates of gelatin can also be used.

It is preferable that dextran and polyacrylamide are used together with gelatin.

Various compounds can be added to the photographic emulsions used in the present invention in order to prevent fogging during the production, storage, or processing of the photographic material, or in order to stabilize the photographic performance. Antifoggants or stabilizers can be added such as azoles (e.g., benzothiazolium salts, nitroimidazoles, nitrobenzimidazoles, chlorobenzimidazoles, bromobenzimidazoles, nitroindazoles, benzotriazoles, and aminotriazoles); mercapto compounds (e.g., mercaptothiazoles, mercaptobenzothiazoles, mercaptobenzimidazoles, mercaptothiadiazoles, mercaptotetrazoles, particularly 1-phenyl-5-mercaptotetrazole, mercaptopyrimidines and mercaptotriazines); thioketo compounds such as oxadrinthione; azaindenes (e.g., triazaindenes, tetraazaindenes particularly 4-hydroxy-substituted 1,3,3a,7-tetraazaindenes), and pentaazaindenes; benzenethiosulfonic acid, benzenesulfinic acid, and benzenesulfonic acid amide.

Particularly, nitron and its derivatives described in Japanese Patent Application (OPI) Nos. 76743/85 and 87322/85, mercapto compounds described in Japanese Patent Application (OPI; No. 80839/85, and heterocyclic compounds and complex salts of heterocyclic compounds with silver (e.g., 1-phenyl-5-mercaptotetrazole silver), described in Japanese Patent Application (OPI) No. 164735/82 are preferred.

Photographic emulsion layers and light-insensitive hydrophilic colloid layers of the present invention are hardened with an inorganic or organic hardening agent so that the melting time may become from 70 to 200 minutes. As hardening agents, use can be made of chromates (e.g., chrome alum); aldehydes (e.g., formaldehyde, and glutaraldehyde); N-methylol compounds (e.g., dimethylol urea, and methyloldimethylhydantoin); dioxane derivatives (e.g., 2,3-dihydroxydioxane); active vinyl compounds (e.g., 1,3,5-triacryloyl-hexahydro-s-triazine, bis(vinylsulfonyl)methylether, and N,N'-methylenebis-[β-(vinylsulfonyl)propionamide]); active halogen compounds (e.g., 2,4-dichloro-6-hydroxy-s-triazine), mucohalogenic acids (e.g., mucochloric acid), isooxazoles dialdehyde starch, and 2-chloro-6-hydroxytriazynylated gelatin, which can be used alone or in combination. Inter alia, active vinyl compounds described in Japanese Patent Application (OPI) Nos. 41221/78, 57257/78, 162546/84, and 80846/85 and active halogen compounds described in U.S. Patent No. 3,325,287 are preferable.

It is preferable that the hydrophilic colloid layer in the present photographic material has been hardened with the hardener mentioned above to have the degree of swelling in water to be 150% or less, preferably 100% or less so that when the hydrophilic colloid layer is immersed in a 1.5 wt% of sodium hydroxide aqueous solution and is allowed therein to stand at 50° C., it takes a period in the range of 70 minutes to 200 minutes to start the dissolution.

The instant photographic emulsion layers and other hydrophilic colloid layers may also contain surface active agents which can serve as a coating assistant, an antistatic agent, a sliding property-improving agent, an emulsifying and dispersing agent, and an adhesion preventive agent. The addition of one or more surface active agents can also improve photographic characteristics of the material (e.g., surface active agents for facilitating the development, for rendering the contrast high, or for improving the sensitization).

Examples of surface active agents are saponins (steroid type); nonionic surface active agents such as alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or -amides and polyethylene oxide adducts of silcones), glycidol derivatives (e.g., alkenyl succinic acid polyglycerides, and alkylphenolpolyglycerides), polyvalent alcohol fatty acid esters, and alkyl esters of saccharides; anionic surface active agents having an acid group such as a carboxyl group, a sulfo group, a phospho group, a sulfate group, or a phosphate group such as alkyl carboxylates, alkyl sulfonates, alkylbenzene sulfonates, alkylnaphthalene sulfonates, alkyl sulfates, alkyl phosphates, N-acyl-N-alkyltaurines, sulfosuccinic acid esters, sulfoalkyl polyoxyethylenealkylphenyl ethers, and polyoxyethylenealkyl phosphates; amphoteric surface active agents such as amino acids, aminoalkyl sulfonates, aminoalkyl sulfates or phosphates, alkyl betaines, and amine oxides; and cationic surface active agents such as alkyl amine salts, aliphatic or aromatic quaternary ammonium salts, heterocyclic quaternary ammonium salts of pyridinium, imidazolium, etc. and aliphatic or heterocyclic phosphonium or sulfonium salts.

Those are described, for example, by Ryohei Oda et al., in *Surface Active Agents and Their Application* (*Kaimenkasseizai to Sono Oyo*), (Makishoten, 1964), by Hiroshi Horiguchi in *New Surface Active Agents* (*Shin Kaimenkasseizai*), (Sankyoshuppan KK, 1975), in *McCutcheon's Detergents & Emulsifiers*, (McCutecheon Divisions, MC Publishing Co., 1985) and in Japanese Patent Application (OPI) Nos. 76741/85, 172343/87, 173459/87, and 215272/87.

As antistatic agents, use can be made of fluorine-containing surface active agents or polymers described in Japanese Patent Application (OPI) Nos. 109044/87 and 215272/87, nonionic surface active agents described, for example, in Japanese Patent Application (OPI) Nos. 76742/85, 80846/85, 80848/85, 80839/85, 76741/85, 208743/83, 172343/87, 173459/87, and 215272/87; and electroconductive polymers or latexes (of nonionic, anionic, cationic or amphoteric types) described in Japanese Patent Application (OPI) Nos. 204540/82 and 215272/87. Further, as inorganic antistatic agents, use can be made of halogen salts, nitrates, perchlorates, sulfates, acetates, phosphates, and thiocyanates of ammonium, alkali metals, and alkali earth metals, and electroconductive tin oxide and zinc oxide or composite oxides obtained by doping these metal oxides with antimony as described, for example, in Japanese Patent Application (OPI) No. 118242/82. Various charge-transfer complexes, π-conjugated polymers that may be doped, organometallic compounds and intercalated compounds can also be used as antistatic agents and examples thereof ar tetracyanoquinodimethane/tetrathiafulvalene, polyacetylene, and polypyrrole. These are described by Morita et al. in *Science and Industry* (*Kagakuto Kogyo*), 59, (3), pp. 103–111 (1985), and 59, (4), pp. 146–152 (1985)

In the present invention, as matting agents use can be made of organic compounds such as starch, a homopolymer of polymethacrylate or a copolymer of methylmethacrylate with methacrylic acid as described in U.S. Pat. Nos. 2,992,101, 2,701,245, 4,142,894, and 4,396,706, and fine particles of inorganic compounds such as silica, titanium dioxide, sulfuric acid and barium strontium.

Preferably the particle size is from 1.0 μm to about 10 μm, and more preferably from 2 μm to about 5 μm.

In the surface protective layer of the present photographic material, use can be made of, as a lubricant, silicon compounds described, for example, in U.S. Pat. Nos. 3,489,576 and 4,047,958, colloidal silicas described in Japanese Patent Publication No. 23139/81 as well as paraffin wax, higher fatty acid esters and starch derivatives.

In the hydrophilic colloid layers of the present photographic material, use can be made of, as plasticizers, polyols such as trimethylolpropane, pentanediol, butanediol, ethylene glycol, and glycelin.

The present silver halide photographic material may have in addition to the photographic silver halide emulsion layer, one or more light-insensitive layers such as a surface protective layer, an intermediate layer and an antihalation layer.

The silver halide emulsion layer may comprise two or more layers, and the sensitivities and gradations of each silver halide emulsion layer may be different.

One or more silver halide emulsion layers and light-insensitive layers may be placed on each side of the support.

As a support for X-ray photography, polyethylene terephthalate film and cellulose triacetate films are preferred. They are preferably colored blue.

The surface of the support is preferably subjected to corona discharge treatment, glow discharge treatment or ultraviolet exposure treatment in order to improve the adhesion to the hydrophilic colloid layer. Alternatively, an undercoat layer of a styrene/butadiene type latex, a vinylidene chloride latex, or the like may be provided, and on the undercoat a gelatin layer may be provided. An undercoat layer using an organic solvent that contains gelatin and a polyethylene swelling agent can be provided. If the undercoat layer is surface-treated, the adhesion to the hydrophilic colloid layer can be improved.

As a support for a general photographic material, cellulose triacetate film, which may be colored for the purpose of antihalation or may not be colored, is preferred.

For the photographic processing of the present photographic material, any known processing solutions and any known methods as described in *Research Disclosure*, Vol. 176, pages 28 to 30 (RD-17643) can be applied. The photographic processing may be either photographic processing of forming a silver image (black-and-white photographic processing) or photographic processing of forming a dye image (color photographic processing). Although the processing temperature is selected generally to be between 18° C. and 50° C., the processing temperature may be lower than 18° C. or higher than 50° C.

The developing solution used for black-and-white photographic processing may contain a known developing agent. Examples include dihydroxybenzenes (e.g., hydroquinone), 3-pyrazolidones (e.g., 1-phenyl-3-pyrazolidone), aminophenols (e.g., N-methyl-p-aminophenol), which can be used alone or in combination. The photographic material can be photographically processed, with a developing solution containing as a silver halide solvent an imidazole described in Japanese Patent Application (OPI) No. 78535/82. It can also be processed with a developing solution containing an additive such as indazole or triazole and a silver halide solvent described in Japanese Patent Application (OPI) No. 37643/83. In addition, the developing solution may contain a known preservative, an alkali agent, a pH buffer, an antifoggant, and, if required, may further contain a solution assistant, a toning agent, a development accelerator, a surface active agent, a defoaming agent, a hard water softener, a hardening agent (e.g., glutaraldehyde) and a tackifier.

As a fixing solution, use can be made of one having a composition generally used.

As a fixing agent, use can be made, in addition to thiosulfates and thiocyanates, of organic sulfur compounds that are known to have the effect as a fixing agent. The fixing solution may contain a hardening agent such as a water-soluble aluminum salt.

The invention will now further be described with reference to the following examples, which are not intended to restrict the invention.

Unless otherwise indicated, all parts, percents, ratios and the like are by weight.

EXAMPLE 1

(1) Preparation of Tabular Grain Silver Halide Emulsions According to the Invention wherein the Average Aspect Ratio of the Grains is 3 or more and the Total Content of Silver Bromide and Silver Chloride is 99 mol% or more

1) Preparation of AgrCl (Br/Cl=10/90 by mol) Tabular Grain Emulsion: (A)

An aqueous poly(3-thiapentylacrylate-co-3-acryloxypropane-1-sulfonic acid sodium salt solution containing calcium chloride, adenine, ammonium nitrate, and sodium bromide was charged into a container warmed to 50° C. and the pH was adjusted to 3.0. An aqueous silver nitrate solution and an aqueous mixed solution of calcium chloride and sodium bromide were added at the same time thereto with the pCl kept constant, at a constant speed, and within 1 minute. Then, the same aqueous silver nitrate solution and the silver halide solution produced above simultaneously added over a period of 40 minutes at an accelerating addition flow rate. The average diameter of the grains produced, which included an insignificant amount of non-tabular grains, was 1.0 μm; the average thickness was 0.15 μm, and the average aspect ratio was 6.67. Thereafter, desalting was carried out in the usual manner; gold/sulfur sensitization using chloroauric acid and sodium thiosulfate were carried out, and as a stabilizer 4-hydroxy-6-methyl 1,3,3a,7-tetrazaindene was

2) Preparation of AgBrCl (Br/Cl=70/30 by mol) Tabular Grain Emulsion (B)

4% of 2.0 mol/l of an aqueous silver nitrate solution and 1.4 mol/l of an aqueous potassium bromide solution (containing 0.94 mol/l of potassium chloride) mixture were added simultaneously to 3 of a solution containing 3.2% of gelatin, 0.47 mol/l of -potassium chloride, and 0.01 mol/l of potassium bromide having a temperature of 50° C. for 40 sec. with the pAg kept constant, and then the remaining 96% of the silver ion solution and the halide solution were added simultaneously at the same pAg over a 70 minute time period so that the flow rate at the completion of the addition was 3 times as high as that of the start of the addition, 2 mols of silver nitrate being used in all. The average diameter of the grains produced, which included an insignificant amount of non-tabular grains, was 0.93 μm; the average thickness was 0.15 μm, and the average aspect ratio of the grains except for non-tabular grains was 6.20. Thereafter, desalting was carried out in the usual manner; gold/sulfur sensitization using chloroauric acid and sodium thiosulfate was carried out, and as a stabilizer 4-hydroxy-6-methyl-1,3,3a,7-tetraazaindene was added to prepare an emulsion (B).

3) Preparation of Pure AgBr Tabular Grain Emulsion (C)

135 cc of an aqueous silver nitrate solution (1.09 mol/l) and 100 cc of an aqueous potassium bromide solution (1.6 mol/l) were added simultaneously to 3 l of an aqueous solution containing 18 g of potassium bromide and 96 g of gelatin at 75° C. over a period of 45 seconds. After a pause of 12 minutes 1690 cc of an aqueous solution of silver nitrate (1.57 mol/l) and an aqueous solution of potassium bromide (1.64 mol/l: were added simultaneously at a pAg equal to 9.26 over a period of 25 minutes with the flow rate accelerated so that the final flow rate was 8 times as high as that of the initial flow rate to complete the formation of the grains. The average diameter of the grains produced, which included an insignificant amount of non-tabular grains, was 0.90 μm; the average thickness was 0.16 μm, and the average aspect ratio of the grains except for non-tabular grains was 5.63. Thereafter, desalting was carried out in the usual manner; gold/sulfur sensitization using chloroauric acid and sodium thiosulfate was carried out, and as a stabilizer 4-hydroxy-6-methyl-1,3,3a,7-tetrazaindene was added to prepare an emulsion (C).

(2) Preparation of Comparative Emulsions

1) Preparation of Regular AgBrCl (Br/Cl=50/50 by mol) Emulsion (D)

2 l of an aqueous halide solution (1.5 mol/l) made up of sodium chloride and potassium bromide (molar ratio: 1:1) and 2 l of an aqueous solution of silver nitrate (1.5 mol/l) were simultaneously added at 70° C. to 3 l of an aqueous solution containing 96 g of gelatin, 10 g of sodium chloride, and 1 g of potassium bromide to prepare regular grains. The form of the grains was cubic; the grain size distribution was narrow, and the average grain size (the length of the side) was 0.52 μm. Thereafter, desalting was carried out in the usual manner; gold/sulfur sensitization using chloroauric acid and sodium thiosulfate was carried out, and as a stabilizer 4-hydroxy-6-methyl-1,3,3a,7-tetrazaindene was added to prepare an emulsion (D).

2) Preparation of Cubic Pure AgBr Emulsion (E)

After 10 ml of NH3 (25 wt%) was added at 60° C. to 3 l of an aqueous solution containing 96 g of gelatin and 0.1 g of potassium bromide, 2 l of an aqueous solution of silver nitrate (1.5 mol/l) and an aqueous solution containing -potassium bromide (1.5 mol/l) were added over 40 min with pAg being controlled to be 7.80 to prepare a cubic monodispersed grain emulsion. The length of the side of the grains was 0.53 μm. The same chemical sensitization as in (2)-1) was carried out and the same stabilizer as in (2)-1) was added to complete the preparation of an emulsion (E).

3) Preparation of Octahedral Pure AgBr Emulsion (F)

In a manner similar to that for (2)-1), a monodispersed octahedron emulsion was prepared with the pAg controlled to be 8.50. The length of the side was 0.67 μm. Chemical sensitization similar to that for (2)-1) was carried out, and the same stabilizer as in (2)-1) was added to complete the preparation of an emulsion (F).

4) Preparation of Low Aspect Ratio AgBrCl (Br/Cl=70/30 by mol) Emulsion (G)

The method of preparing emulsion (B) was repeated, except that the pAg value was set lower than that of emulsion (B), the first addition time was more prolonged, the second addition time was more shortened, and the temperature was set a little higher. In comparison to emulsion (B), grains that were not tabular increased clearly, and the aspect ratio lowered. The average diameter of the grains produced was 0.80 μm; the average grain thickness was 0.28 μm, and the average aspect ratio was 2.86. Chemical sensitization similar to that for emulsion (B) was carried out, and the same stabilizer as used in emulsion (B) was added to complete the preparation of emulsion (G).

5) Preparation of High Aspect Ratio AgBrI (Br/I=97/3 by mol) Emulsion (H)

The method of preparing emulsion (C) was repeated, except that instead of the aqueous solution of potassium bromide that was added simultaneously, an aqueous potassium bromide solution containing 3 mol% of potassium iodide was used, the pAg value was higher, and the addition time was the same. The average diameter of the grains was 1.12 μm; the average thickness was 0.145 μm, and the average aspect ratio was 7.72. Chemical sensitization similar to that for (2)-4) was carried out and the same stabilizer was added to complete the preparation of emulsion (H).

(3) Preparation of Emulsion Coating Liquid, Surface Protective Layer Coating Liquid, and Coated Sample Each emulsion was weighed so that the quantity of silver was 1 mol, and after the emulsion was dissolved at 40° C. and a trace amount (≦0.1 mol%) of potassium iodide was added, 400 mg of a sensitizing dye (I) having the following structural formula:

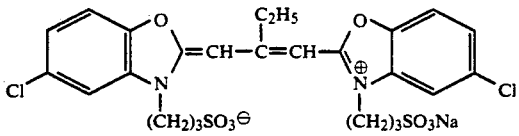

(I)

were added to effect ortho-sensitization.

Further, as a coating assistant, dodecylbenzenesulfonic acid and, as a thickener, sodium polystyrenesulfonate were added to produce a coating liquid of an emulsion layer. At that time, the weight ratio of silver/gelatin was 1.05. On the other hand, as a surface protective layer, an aqueous 7 wt% gelatin solution containing polymethyl methacrylate fine particles, saponin, sodium polystyrenesulfonate, etc. was prepared as a basic formulation. To this formulation, polyacrylamide having a molecular weight of 7,000 was added in an amount of 61.5% of the gelatin and was dissolved thereinto. Further, just before the coating, N,N'-ethylenebis(vinylsulfonylacetamide), as a hardening agent, was added to the formulation in an amount that it was 5 wt% of gelatin in the formulation and would be involved in the crosslinkage of the emulsion layer. Each emulsion coating liquid A to H was applied to one surface of a polyethylene terephthalate support such that the amount of silver applied was 1.9 g/m$^2$, and the surface protective coating liquid was applied to the other surface such that the amount of gelatin applied was 1.3 g/m$^2$, thereby forming double-coated samples A to H.

(4) Sensitometry 25 On the seventh day after those samples were kept at 25° C. and 65% RH, the samples were subjected to double-surface exposure through a continuous wedge by 500 to 650-nm green light having an intensity peak at 520 nm. )The samples were then developed in the following processing manner by using an automatic developing machine that was disclosed in Japanese Patent Application No. 27340/87 and schematically illustrated in the Figure, wherein reference numeral 1 indicates a developing tank, reference numeral 2 a fixing tank, reference numeral 3 a washing tank, reference numeral 4 a water stock tank, reference numeral 5 a stock tank for a condensed developing solution, reference numeral 6 a stock tank for a condensed fixing solution, and reference numeral 7 a squeezing roller washing tank, and symbol (p) indicates a pump.

Developer Condensed Solution

Potassium hydroxide: 60 g
Sodium sulfite: 100 g
Potassium sulfite: 125 g
Diethylenetriaminepentaacetic acid: 6 g
Boric acid: 25 g
Hydroquinone: 87.5 g
Diethylene glycol: 28 g
4-hydroxymethyl-4-methyl-1-phenyl-3-pyrazolidone: 4.2 g
5-methylbenzotriazole: 0.15 g
Water to make: 1 l
The pH was adjusted to 11.00.
The replenishing solution kit size was 5 l.

Fixer Condensed Solution

Ammonium thiosulfate: 560 g
Sodium sulfite: 60 g
Disodium ethylenediaminetetraacetate: 0.10 g dihydrate
Sodium hydroxide: 24 g
Water to make: 1 l
The pH was adjusted to 5.10 by using acetic acid.
The replenishing solution kit size was 5 l.

Water Stock Tank Solution

Disodium ethylenediaminetetraacetate: 0.5 g/l dihydrate (fungicide)

The samples were processed by the automatic developing machine as illustrated in the Figure for 45 seconds in a dry-to-dry manner.

The developing tank (1): 7.5 l 35° C.×8.6 sec (opposite rollers)
The fixing tank (2): 7.5 l 35° C.×9.4 sec (opposite rollers)
The washing tank (3): 6 l 20° C.×5.6 sec (opposite rollers)
The squeezing roller washing tank (7): 200 ml
The water stock tank (4): 25 l
Drying Although heaters were used to maintain the temperature of the developing tank and the fixing tank, cooling water was not used.

When the development processing was about to be started, each tank was filled with the following processing solutions.

The developing tank (1): 400 ml of the above developer condensed solution, and 600 ml of water were added and the pH was adjusted to 10.50 by adding 10 ml of an aqueous solution containing 2 g of potassium bromide and 1.8 g of acetic acid.

The fixing tank (2): 250 ml of the above fixer condensed solution and 750 ml of water were added.

The washing tank (3) and the washing tank (7): the same composition as that of the above water stock tank solution was added.

As shown schematically in the Figure of the automatic developing machine, every time when one piece of the above photosensitive material B4 size (25.7 cm×36.4 cm) was processed, the following replenishments were made:

the developing tank 20 ml of the developer condensed solution and 30 ml of the stock tank water,
to the fixing tank 10 ml of the fixer condensed solution and 30 ml of the overflow of the washing tank and
to the washing tank from the squeezing roller washing tank (in the opposite direction to the direction of the film) 60 ml of the stock tank water, and running processing of 50 pieces of the B4 size per day (the developing rate of one film: 40% (i.e., exposed samples of 20 pieces)) was continued. During that time, when the developing solution, the fixing solution, and water ran short, the replenishing solutions were supplied accordingly.

When the photosensitive material was being developed, the circulated stirring solution quantity of the developing solution was set to 14 l/min, and when the development was not made, that is, during the waiting period, the circulated stirring solution quantity was set to 6 l/min.

When the day's developing work had been completed, 80 ml of water from the washing water stock tank was automatically spouted intermittently from 10 small holes onto each of the rollers of the crossover between the fixing and the washing and between the development and the fixing to wash them (according to the method described in Japanese Patent Application No. 131338/86).

With respect to the samples that were subjected to 45 second dry-to-dry processing and the samples that were subjected to 90 second dry-to-dry processing with the period of each of the steps doubled, the relative value of the sensitivity (the value of common logarithm of the reciprocal of the exposure amount required to obtain a transmission light blackening density of Fog+1.0) of each sample is given in Table 1 with the sensitivity of the sample A standardized to be 1.00. The maximum density value ($D_{max}$) for each exposure amount is also shown. The dried state of all of these samples by the automatic developing machine (dry-to-dry 45-sec processing) was satisfactory. When the samples were immersed in an aqueous solution containing 1.5 wt% of sodium hydroxide at 50° C. and allowed to stand, the time (MT) required until they started to dissolve was between 100 and 105 min. The granularity of these samples were all satisfactory since infectious development did not substantially occur.

TABLE 1

| Sample No. | Emulsion | Properties of Emulsion: Halogen Composition | Average Aspect Ratio | Average Diameter corresponding to Circle | Dry-to-dry 90-sec Processing: Relative Sensitivity | Dmax | Dry-to-dry 45-sec Processing: Relative Sensitivity | Dmax | Remarks |
|---|---|---|---|---|---|---|---|---|---|
| A | (A) | AgBrCl Br/Cl = 10/90 | 6.67:1 | 1.00 μm | 1.00 | 3.42 | 0.97 | 3.29 | Invention |
| B | (B) | AgBrCl Br/Cl = 70/30 | 6.20:1 | 0.93 μm | 1.04 | 3.45 | 0.98 | 3.33 | " |
| C | (C) | AgBr | 5.63:1 | 0.90 μm | 1.09 | 3.40 | 1.03 | 3.28 | " |
| D | (D) | AgBrCl Br/Cl = 50/50 | Cube | 0.52 μm (length of one side) | 0.83 | 1.95 | 0.76 | 1.80 | Comparison |
| E | (E) | AgBr | Cube | 0.53 μm (length of one side) | 0.89 | 1.92 | 0.82 | 1.76 | " |
| F | (F) | AgBr | Octa-hedron | 0.67 μm (length of one side) | 0.85 | 2.45 | 0.78 | 2.21 | " |
| G | (G) | AgBrCl Br/Cl = 70/30 | 2.86:1 | 0.80 μm | 0.92 | 3.04 | 0.86 | 2.82 | " |
| H | (H) | AgBrI Br/I = 97/3 | 7.72:1 | 1.12 μm | 1.02 | 3.25 | 0.72 | 2.68 | " |

It is apparent from Table 1 that although emulsion (G) having an aspect ratio less than 3 that contains iodine in an amount that is insignificant in view of the total halogen composition, shows an excellent development rate, the $D_{max}$ is remarkably low (the developed silver covering power is low). On the other hand, although emulsion (H) containing iodine has a high aspect ratio, the rate of development is remarkably worse, the sensitivity is worse, and the loss of the $D_{max}$ is high particularly in short period development. It is clear that only the present emulsions (A) to (C) having a high aspect ratio that contain iodine in an amount that is insignificant in view of the halogen composition are excellent in rate of development, $D_{max}$, and sensitivity.

EXAMPLE 2

Example 1 was repeated, except that the chemical sensitization and the spectral sensitization of the 8 produced emulsions were changed as described below. After the desalting, each emulsion was redispersed, then dispersed gelatin was added and dissolved, the emulsions were warmed to 55° to 65° C., a trace amount (≦0.1 mol%/mol of Ag) of iodine was added and the sensitizing dye used in Example 1 was added. Then, after 10 minutes had passed, gold/sulfur sensitization using chloroauric acid and sodium thiosulfate was carried out, and as a stabilizing agent 4-hydroxy-6-methyl-1,3,3a,7-tetraazaindene in an amount smaller than in Example 1 was added to complete the preparation of 8 emulsions. The emulsions were named (a) to (h) to correspond to (A) to (H). Thereafter, other additives were added in the same way as Example 1 to prepare samples. The same development processing as in Example 1 was performed, and the results were analyzed Although the sensitivity and the rate of development of sample (h), consisting of the high aspect ratio emulsion and containing iodine, became relatively high, they did not reach the level of the samples according to the invention which contained less than 0.1 mol% iodide per mol of Ag. Thus, in this case it was clearly illustrated that the rate of development and the $D_{max}$ of the samples according to the invention, e.g., samples (a) to (c), are superior.

EXAMPLE 3

Example 2 was repeated, except that the sensitizing dye in Example 2 was replaced with a sensitizing dye (II) having the following structural formula:

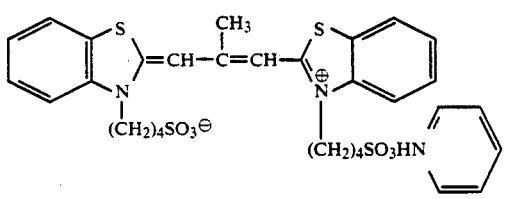

and the sensitizing dye (II) was added in an equimolar amount after the chemical sensitization, thereby preparing samples similar to those in Example 2.

In this case, sensitometry was carried out using white light, and it was illustrated that the samples consisting of a high aspect ratio that contained iodine in an amount that was insignificant in view of the total halogen composition were superior.

EXAMPLE 4

Example 1 was repeated, except that the sensitizing dye was replaced with a sensitizing dye (III) having the following structural formula:

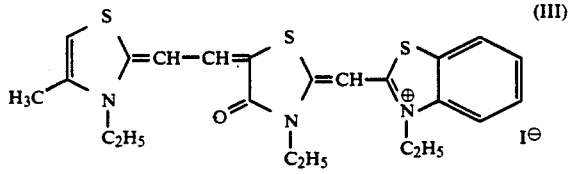

and the sensitizing dye (III) was added in a half amount by mol of the sensitizing dye (I) after the chemical sensitization, and each of the emulsions was applied to only one surface of a support so that the amount of silver applied was 3 g/m² to prepare samples similar to those in Example 1.

The exposure was carried out by using a He-Ne-laser beam (exposure time = $10^{-4}$ sec). It was shown that the rate of development and the $D_{max}$ of the samples according to the invention that consisted of high aspect ratio emulsions and which contained iodine in an amount that was insignificant in view of the total halogen composition were superior.

EXAMPLE 5

Example 1 was repeated, except that the sensitizing dye was replaced with a sensitizing dye (IV) having the structural formula given below, the amount of which was quarter by mol to sensitizing dye (I). As a supersensitizing dye, a compound having the structural formula (V) given below was also added in an amount of forty times by weight to that of the sensitizing dye (IV), and each of the emulsions was applied to only one surface of a support so that the amount of silver applied was 3 g/ml to prepare samples similar to those in Example 1.

(IV)

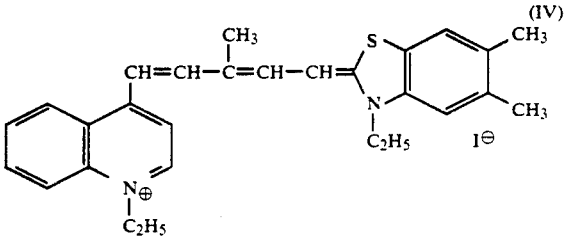

(V)

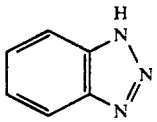

The exposure was carried out by using a semiconductor laser with the exposure time being $5\times10^{-7}$ seconds.

It wa shown that the rate of development and the $D_{max}$ of the samples according to the invention that consisted of emulsions having a high aspect ratio and which contained iodine in an amount that was insignificant in view of the total halogen composition were superior.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material comprising subjecting to a development processing an image-wise exposed silver halide photographic material comprising a support having coated thereon at least one silver halide emulsion layer and at least one light-insensitive hydrophilic colloid layer, wherein said emulsion layer comprises tabular grains of silver chloride, silver bromide, silver chlorobromide or silver chloroiodobromide having an iodide content of 1 mol% or less, which have an average aspect ratio of 3 or more and which have been spectrally sensitized with at least one spectral sensitizing dye represented by general formulae (I), (II), (III), (IV), (V) and (VI):

(I)

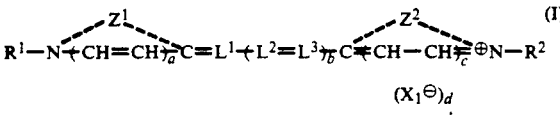

-continued (II)

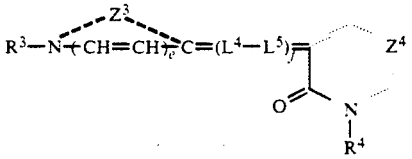

(III)

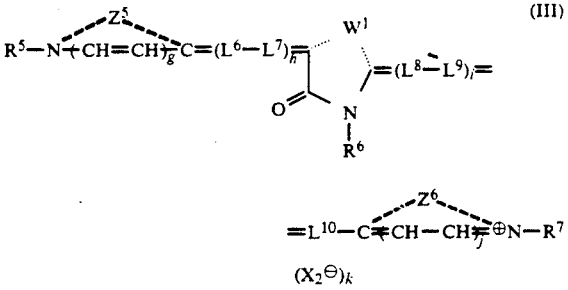

(IV)

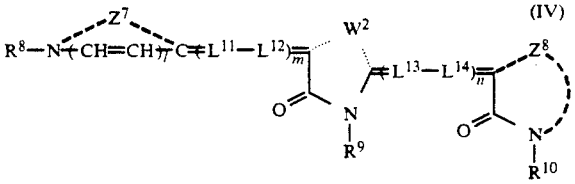

(V)

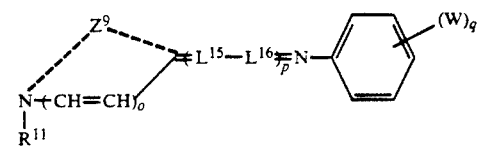

(VI)

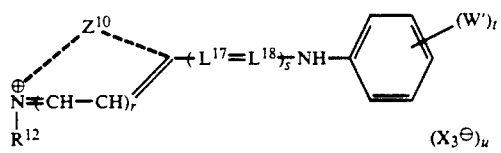

wherein, $Z^1$ and $Z^{10}$ and $W^1$ and $W^2$, which may be the same or different, each represents a group of non-metal atoms, which together with the adjacent atoms, form a 5- or 6-membered heterocyclic ring; $R^1$, $R^2$, $R^3$, $R^5$, $R^7$, $R^8$, $R^{11}$ and $R^{12}$, which may be the same or different, each represents a hydrogen atom, a substituted or unsubstituted alkyl group, a substituted or unsubstituted aryl group, or a heterocyclic group; a, c, d, e, g, h, j, k, l, o, r and u each independently is 0 or 1; b, f, i, m, n, p, q, s and t each independently is 0, 1, 2 or 3; $L^1$ to $L^{18}$ each represents a substituted or unsubstituted methine group; $X_1$ and $X_3$ each represents an anion; and W and W' each represents a halogen atom, a cyano group, an alkoxycarbonyl group, a substituted or unsubstituted carbamoyl group, a substituted or unsubstituted alkyl group, a substituted or unsubstituted alkoxy group or a substituted or unsubstituted acyl group, and wherein the melting time of the hydrophilic colloid layer in the photographic material is from 70 to 200 minutes at 50° C.;

and wherein said silver halide photographic material is a medical X-ray silver halide photographic material or a CRT image silver halide photographic material.

2. A method for processing a silver halide photographic material of claim 1, wherein said development processing of said silver halide photographic material is with a developing solution free of a processing hardening agent.

3. A method of claim 1, wherein said development process is conducted with 45 seconds in a dry-to-dry manner.

4. A method for processing a silver halide photographic material as in claim 1, wherein the spectral sensitizing dye is represented by the formula:

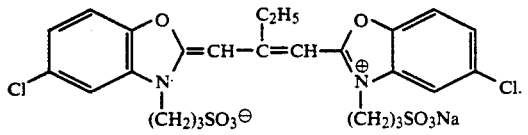

5. A method for processing a silver halide photographic material as in claim 1, wherein the spectral sensitizing dye is represented by the formula:

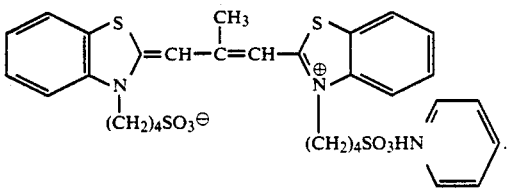

6. A method for processing a silver halide photographic material as in claim 1, wherein the spectral sensitizing dye is represented by the formula:

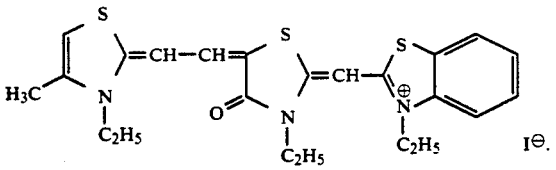

7. A method for processing a silver halide photographic material as in claim 1, wherein the spectral sensitizing dye is represented by the formula:

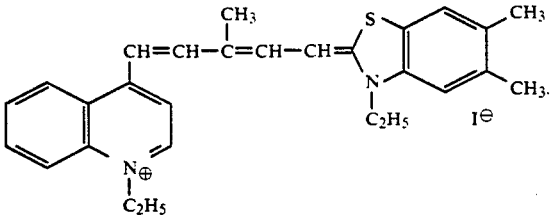

8. A method for processing a silver halide photographic material as in claim 1, wherein the total amount of spectral sensitizing dye is from $4\times10^{-6}$ mols to $8\times10^{-3}$ mols per mol of the silver halide present in said emulsion layer.

9. A method for processing a silver halide photographic material as in claim 1, wherein the average aspect ratio of said tubular grains is at least 5:1.

10. A method for processing a silver halide photographic material as in claim 9, wherein the average aspect ratio of said tubular grains is at least 7:1.

11. A method for processing a silver halide photographic material as in claim 10, wherein the average aspect ratio of said tubular grains is at least 10:1.

12. A method for processing a silver halide photographic material as in claim 11, wherein the average diameter of said tabular grains is at least 0.4 μm.

13. A method for processing a silver halide photographic material as in claim 12, wherein the average diameter of said tabular grains is from 0.5 μm to 2.0 μm.

14. A method for processing a silver halide photographic material as in claim 1 wherein said silver halide photographic material additionally comprises a super sensitizing dye having the formula:

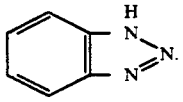

15. A method for processing a silver halide photographic material as in claim 1, wherein said silver halide photographic material is one produced by adding said spectral sensitizing dye to said silver halide emulsion between the completion of the addition of silver ions and immediately before coating said emulsion on said support.

16. A method for processing a silver halide photographic material as in claim 1, wherein said silver halide photographic material is a medical X-ray silver halide photographic material.

17. A method for processing a silver halide photographic material as in claim 1, wherein said silver halide photographic material is a CRT image silver halide photographic material.

* * * * *